US007508364B2

(12) United States Patent
Ono

(10) Patent No.: US 7,508,364 B2
(45) Date of Patent: Mar. 24, 2009

(54) IMAGE DISPLAY DEVICE

(75) Inventor: Shinya Ono, Kanagawa (JP)

(73) Assignees: Kyocera Corporation, Kyoto (JP); Chi Mei Optoelectronics Corp., Tainan County (TW)

( * ) Notice: Subject to any disclaimer, the term of this patent is extended or adjusted under 35 U.S.C. 154(b) by 817 days.

(21) Appl. No.: 11/007,164

(22) Filed: Dec. 9, 2004

(65) Prior Publication Data

US 2005/0156832 A1 Jul. 21, 2005

(30) Foreign Application Priority Data

Dec. 10, 2003 (JP) ..... 2003-412349

(51) Int. Cl.
*G09G 3/30* (2006.01)

(52) U.S. Cl. ..... 345/76

(58) Field of Classification Search ..... 345/204, 345/76

See application file for complete search history.

(56) References Cited

U.S. PATENT DOCUMENTS 6,943,501 B2 * 9/2005 Kobayashi et al. ..... 315/169.3
7,224,333 B2 * 5/2007 Yamazaki et al. ..... 345/82
7,348,944 B2 * 3/2008 Miwa et al. ..... 345/76
2001/0026251 A1 * 10/2001 Hunter et al. ..... 345/55
2002/0140364 A1 * 10/2002 Inukai ..... 315/169.3
2003/0025656 A1 * 2/2003 Kimura ..... 345/82
2003/0146888 A1 * 8/2003 Yamazaki et al. ..... 345/82
2004/0090186 A1 * 5/2004 Yoshida et al. ..... 315/169.1

OTHER PUBLICATIONS

Society of Information Display 2003 Digest, "A 3.5-inch OLED Display using a 4-TFT Pixel Circuit with an Innovative Pixel Driving Scheme," H. Kageyama et al., pp. 96-99.

* cited by examiner

*Primary Examiner*—Bipin Shalwala
*Assistant Examiner*—Afroza Y Chowdhury
(74) *Attorney, Agent, or Firm*—Birch, Stewart, Kolasch & Birch, LLP

(57) ABSTRACT

A image display device includes a driving unit that includes a first terminal and a second terminal, and controls current flowing through a light emitting unit based on a potential difference applied between the first terminal and the second terminal. The potential difference is higher than a predetermined drive threshold. The image display device also includes a threshold potential detecting unit that detects the potential difference; a luminance potential supplying unit that changes the potential difference to a value lower than the drive threshold by a luminance potential corresponding to a luminance of the light emitting unit; and a sweep potential supplying unit that controls the driving unit by supplying a sweep potential to the first terminal. The sweep potential is swept in a range between a value lower than the luminance potential and a value higher than the luminance potential.

4 Claims, 13 Drawing Sheets

FIG.9A "CONVENTIONAL ART"
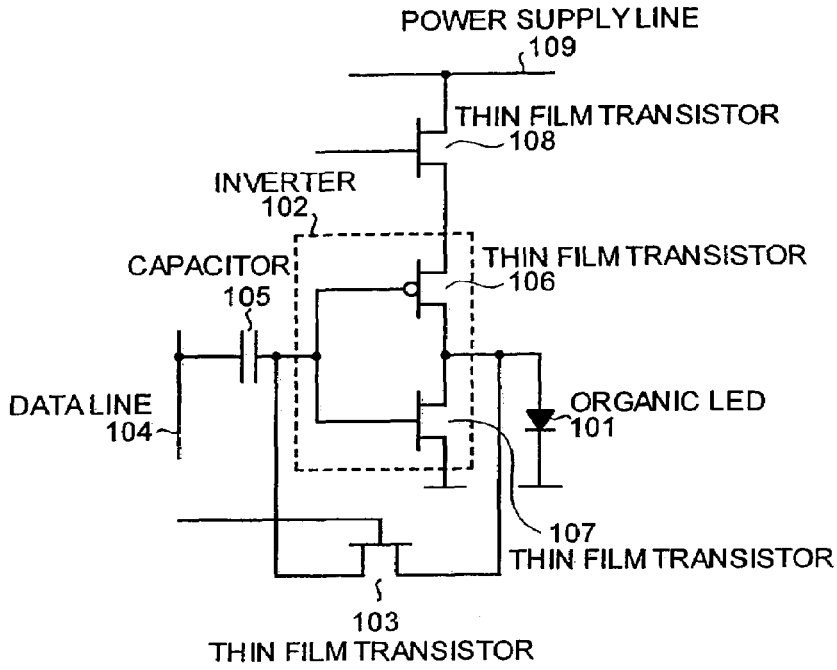
FIG.9B "CONVENTIONAL ART"
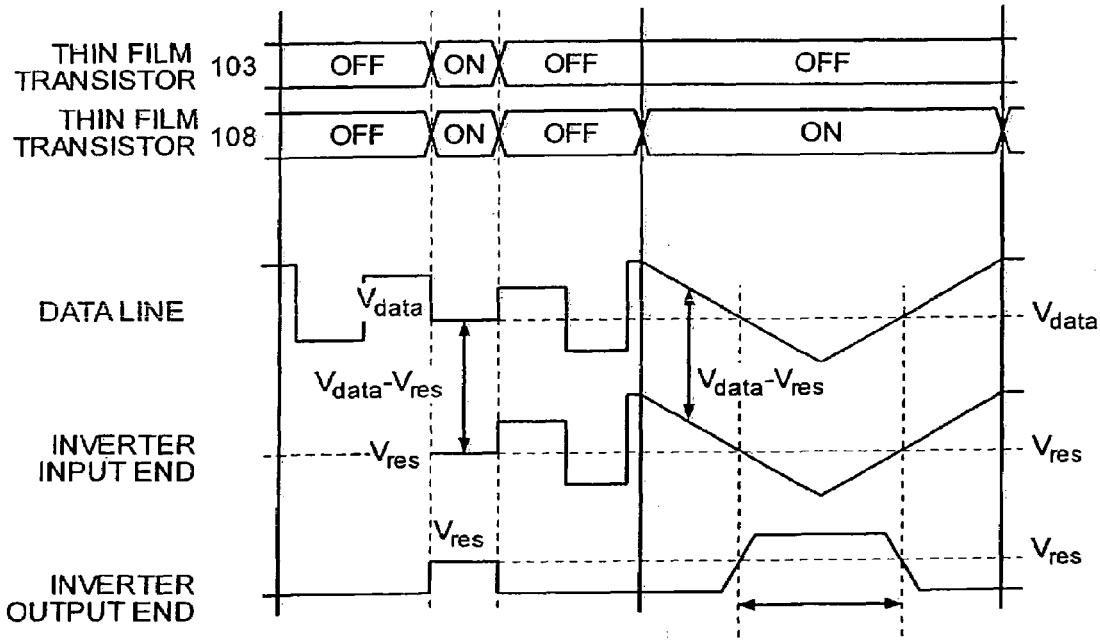

IMAGE DISPLAY DEVICE

BACKGROUND OF THE INVENTION

1) Field of the Invention

The present invention relates to an image display device that displays an image by changing a light-emission time according to display luminance.

2) Description of the Related Art

In a drive circuit of the image display device using an organic light emitting diode (OLED), the drive circuit in which light-emission luminance of the OLED is not changed but a light-emission time of the OLED is changed has been proposed in order to realize display luminance in each pixel. That is, in any pixel, the light-emission time of the OLED is lengthened when high intensity display is performed, and the light-emission time is shortened when low intensity display is performed.

As shown in FIG. 9A, the conventional image display device includes an OLED 101, an inverter 102 whose output terminal is connected to an anode side of the OLED, a thin film transistor 103 that functions as a switching element for resetting the inverter 102 by causing an input terminal and the output terminal of the inverter 102 to conduct, a data line 104 that supplies data potential according to the display luminance and sweep potential required during light emission as described later, and a capacitor 105 that is arranged between the data line 104 and the inverter 102. The inverter 102 is formed by a p-type thin film transistor 106 and an n-type thin film transistor 107. Specifically, drain electrodes of the thin film transistors 106 and 107 are connected to each other to form the output terminal, and gate electrodes of the thin film transistors 106 and 107 are connected to each other to form the input terminal. While a source electrode of the thin film transistor 107 is grounded, the source electrode of the thin film transistor 106 is connected to a power supply line 109 through an n-type thin film transistor 108.

FIG. 9B is a time chart that depicts potential sweeps during the operation of the conventional image display device shown in FIG. 9A. As shown in FIG. 9B, the operation of the conventional image display device is divided into an address period in which the data potential is written according to the luminance and a light-emission period in which light is emitted based on the data potential written. In the address period, the write of data potential $V_{data}$ from the data line 104 and a process of resetting the inverter 102 are simultaneously performed, and a difference ($V_{data}-V_{res}$) between the written potential $V_{data}$ and potential $V_{res}$ given to the input terminal of the inverter 102 by the reset process is generated between electrode plates of the capacitor 105.

In the light-emission period, the sweep potential having a triangle waveform is supplied from the data line 104, and the potential at the output terminal of the inverter 102 is larger than the reset potential $V_{res}$ in the period in which the sweep potential is lower than the data potential $V_{data}$. The OLED 101 is emits the light in the period, so that the OLED 101 emits the light only for a time according to the data potential $V_{data}$ supplied from the data line 104.

However, because the conventional image display device using the OLED has a configuration in which the inverter 102 is included, there are problems in that production becomes complicated and electrical power consumption is increased. These problems are explained below.

As shown in FIG. 9A, the inverter 102 has the configuration in which the p-type thin film transistor 106 and the n-type thin film transistor 107 are included. When the thin film transistors having the different conduction types are formed on the same substrate, because it is necessary to produce the thin film transistors through the different processes, there are problems in that production processes becomes complicated and production cost is increased.

Further, in the conventional image display device, as described above, when the data potential is written by the data line 104, it is necessary to perform the reset process by establishing a short circuit between the output terminal and the input terminal of the inverter 102 with the thin film transistor 103. The power consumption required for the reset process reaches 15% of all the power consumptions required for drive of the image display device, which prevents the decrease in power consumption.

SUMMARY OF THE INVENTION

It is an object of the present invention to at least solve the problems in the conventional technology.

A image display device according to one aspect of the present invention includes a light emitting unit that emits light by current injection; and a driving unit that includes a first terminal and a second terminal, and controls current flowing through the light emitting unit based on a potential difference applied between the first terminal and the second terminal. The potential difference is higher than a predetermined drive threshold. The image display device also includes a threshold potential detecting unit that detects the potential difference; a luminance potential supplying unit that changes the potential difference to a value lower than the drive threshold by a luminance potential corresponding to a luminance of the light emitting unit; and a sweep potential supplying unit that controls the driving unit by supplying a sweep potential to the first terminal after the potential changed by the luminance potential supplying unit. The sweep potential is swept in a range between a value lower than the luminance potential and a value higher than the luminance potential.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 9A is a circuit diagram of the conventional image display device, and FIG. 9B is a time chart of potential sweep at some nodes of the conventional image display device.

DETAILED DESCRIPTION

Exemplary embodiments of an image display device according to the present invention will be explained below with reference to the accompanying drawings. It should be noted that the drawings herein shown are to be taken as a preferred example and are not different from the realistic drawing, and there is also the difference in size or ratio among the drawings.

Figure 1:
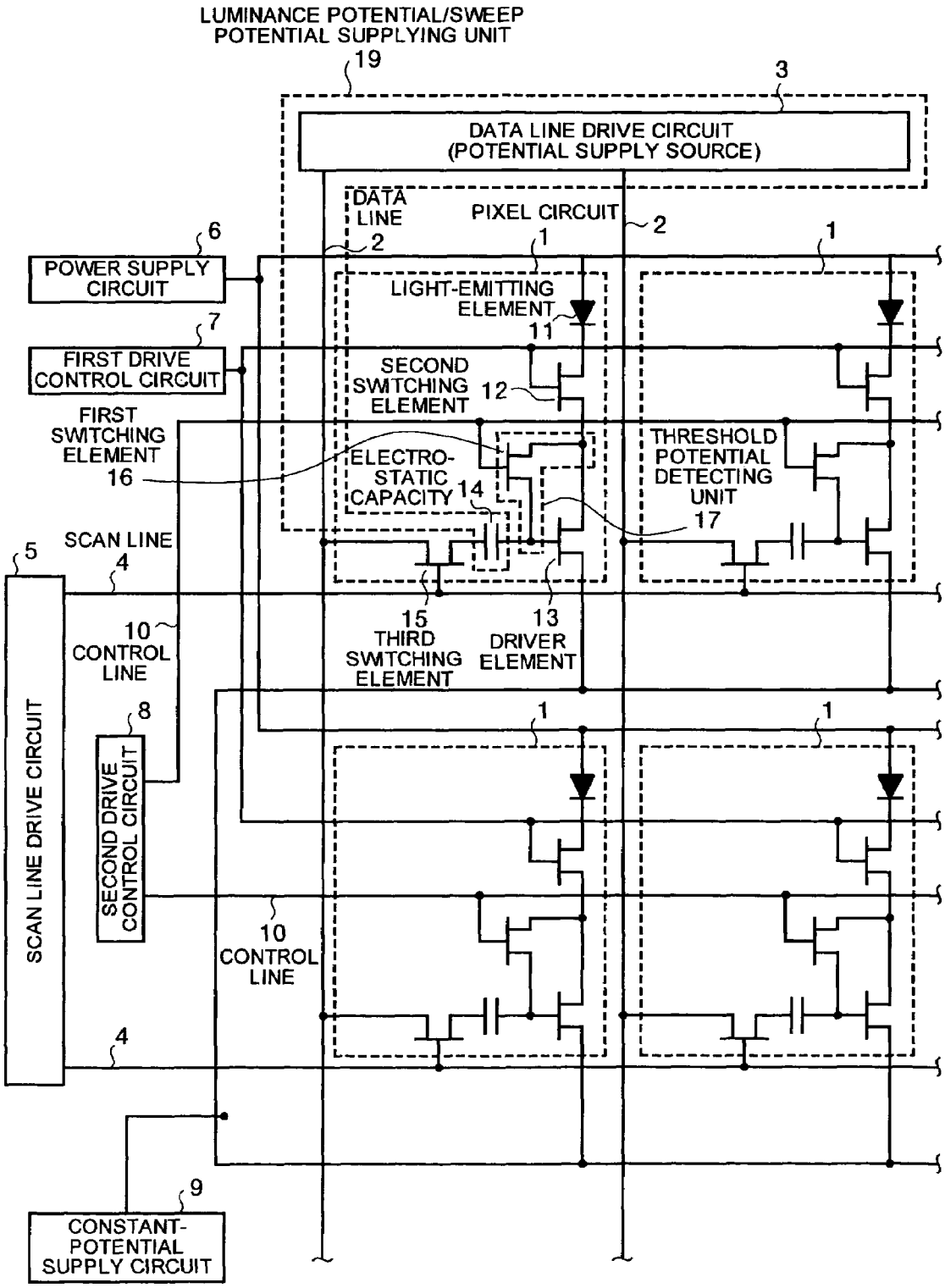
FIG. 1 is a block diagram of an image display device according to a first embodiment.

An image display device according to a first embodiment is explained. FIG. 1 is a block diagram of the image display device according to the first embodiment. As shown in FIG. 1, the image display device includes a plurality of pixel circuits 1 arranged in a matrix shape, a data line drive circuit 3 (corresponding to a potential supply source in the scope of the invention) that supplies luminance potential and sweep potential to the pixel circuits 1 through a data line 2, and a scan line drive circuit 5 that supplies a scanning signal to the pixel circuits 1 through a scan line 4. The scanning signal selects the pixel circuit 1 to which a luminance signal is supplied. The image display device also includes a power supply circuit 6 that supplies drive power to a light-emitting element 11 provided in the pixel circuit 1, a first drive control circuit 7 that controls the drive of a second switching element 12 provided in the pixel circuit 1, a second drive control circuit 8 that controls the drive of a threshold potential detecting unit 17 provided in the pixel circuit 1, and a constant-potential supply circuit 9 that supplies reference potential, for example zero potential to the pixel circuit 1.

The pixel circuit 1 includes a light-emitting element 11 whose anode side is electrically connected to the power supply circuit 6, a second switching element 12 whose one terminal is connected onto a cathode side of the light-emitting element 11, and a driver element 13. The driver 13 is formed by the n-type thin film transistor, the drain electrode of the driver element 13 is connected to the other terminal of the second switching element 12, and the source electrode is electrically connected to the constant-potential supply circuit 9. The pixel circuit 1 also includes an electrostatic capacity 14 whose one electrode plate is connected to the gate electrode of the thin film transistor constituting the driver element 13, a third switching element 15 that is arranged between the other electrode plate of the electrostatic capacity 14 and the data line 2, and a threshold potential detecting unit 17 that is formed by a first switching element 16. The first switching element 16 controls a conduction state between the gate and the drain of the thin film transistor that forms the driver element 13.

The light-emitting element 11 has a mechanism that emits the light by current injection, and the light-emitting element 11 is formed by, for example the OLED. The OLED has a structure that includes at least an anode layer and cathode layer made of Al, Cu, ITO (Indium Tin Oxide), and the like and a light-emission layer made of an organic material, such as phthalocyanine, a tris-aluminum complex, and benzoquinolinol-beryllium complex, between the anode layer and the cathode layer. The OLED has the function of emitting the light by luminance-recombining a hole and an electron that are injected in the light-emission layer.

The second switching element 12 has the function of controlling the conduction between the light-emitting element 11 and the driver element 13. In the first embodiment, the second switching element 12 is formed by the n-type thin film transistor. That is, the second switching element 12 has the configuration in which the gate electrode of the thin film transistor is electrically connected to the first drive control circuit 7 while the drain electrode and the source electrode are connected to the light-emitting element 11 and the driver element 13 respectively, which controls the conduction state between the light-emitting element 11 and the driver element 13 based on the potential supplied from the first drive control circuit 7.

The driver element 13 has the function of controlling the time in which current passes through the light-emitting element 11. Specifically, the driver element 13 has the function of controlling the current passing through the light-emitting element 11 according to the potential difference more than the drive threshold applied between a first terminal and a second terminal, and the driver element 13 has the function of continuously feeding the current through the light-emitting element 11 while the potential difference is applied. In the first embodiment, the driver element 13 is formed by the n-type thin film transistor. The driver element 13 controls the light-emission time of the light-emitting element 11 according to the potential difference applied between the gate electrode corresponding to the first terminal and the source electrode corresponding to the second terminal.

The electrostatic capacity 14 is combined with the data line drive circuit 3 to form a luminance potential/sweep potential supplying unit 19. The luminance potential/sweep potential supplying unit 19 functions as luminance potential supplying means and sweep potential supplying means in the scope of the invention. In the operation of the luminance potential supplying means, after detecting the potential difference (hereinafter, "threshold voltage") corresponding to the drive threshold of the driver 13, the luminance potential/sweep potential supplying unit 19 has the function of changing the potential difference between the first terminal (gate electrode) and the second terminal (source electrode) of the driver element 13 to the value lower than the threshold voltage by the luminance potential. After operating as the luminance potential supplying means, the luminance potential/sweep potential supplying unit 19 operates as the sweep potential supplying means. The luminance potential/sweep potential supplying unit 19 has the function of supplying the sweep potential to the first terminal of the driver element 13. The sweep potential sweeps between the value lower than the luminance potential and the value higher than the luminance potential, namely the sweep potential has the triangle waveform in which the potential is linearly increased from zero to the maximum potential and then returns to zero.

The third switching element 15 has the function of controlling the conduction state between the data line 2 and the electrostatic capacity 14. In the first embodiment, the third switching element 15 is formed by the n-type thin film transistor. The third switching element 15 has the configuration in which one of source/drain electrodes is connected to the data line 2 and the other source/drain electrode is connected to the electrostatic capacity 14. Further, the third switching element 15 has the configuration in which the gate electrode is electrically connected to the scan line drive circuit 5 through the scan line 4, that controls the conduction state between the data line 2 and the electrostatic capacity 14 based on the potential supplied from the scan line drive circuit 5.

The threshold voltage detecting unit 17 detects the threshold voltage of the driver element 13. In the first embodiment, the threshold voltage detecting unit 17 is formed by the first switching element 16 that is of the n-type thin film transistor. In the first switching element 16, one of source/drain electrodes of the thin film transistor is connected to the drain electrode of the driver element 13, the other source/drain electrode is connected to the gate electrode of the driver element 13, and the gate electrode of the thin film transistor is electrically connected to the second drive control circuit 8. Accordingly, the threshold voltage detecting unit 17 has the function of performing the electrical conduction between the gate and the drain of the thin film transistor constituting the driver element 13 based on the potential supplied from the second drive control circuit 8, and the threshold voltage detecting unit 17 also has the function of detecting the threshold voltage that the electrical conduction is performed between the gate and the drain.

Then, the operation of the image display device of the embodiment is explained. The image display device sets the potential difference between the gate and the source of the driver element 13 to the threshold voltage, and then the image display device changes the potential difference to the value in which an absolute value of the potential difference is lower than the threshold voltage by the luminance potential. Then, the image display device is causes the light-emitting element 11 to emit the light only for the period in which the sweep potential is higher than the luminance potential by supplying the sweep potential gradually changed from the value lower than the luminance potential to the value higher than the luminance potential to the gate electrode having such potential.

Figure 2:
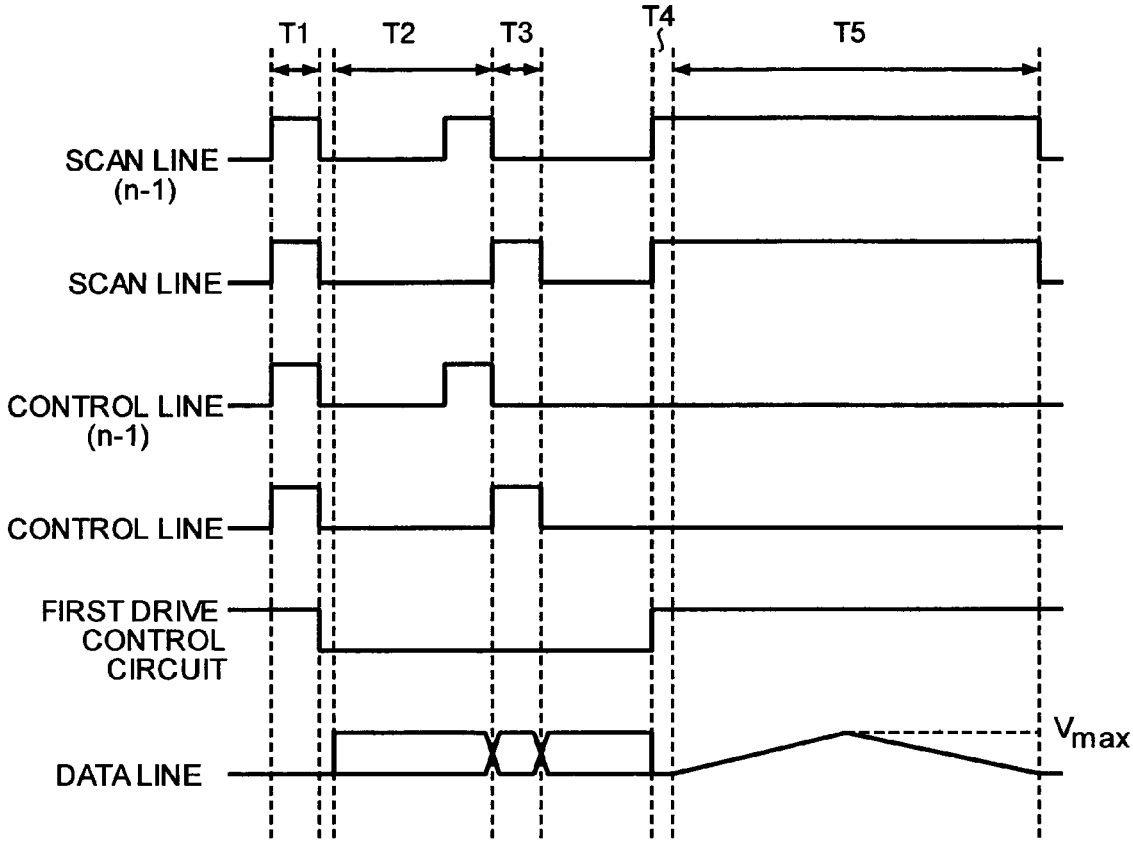
FIG. 2 is a time chart of potential at some nodes of the image display device according to the first embodiment.

FIG. 2 is a time chart of potential at some nodes of the image display device according to the first embodiment. In FIG. 2, a scan line (n−1) and a control line (n−1) show the time charts of the scan line and the control line corresponding to the pixel circuit 1 located in a fore-step for the purpose of reference. FIGS. 3A to 3E are block diagrams that depict the state of the pixel circuit 1 corresponding to a period T1 to a period T5 shown in FIG. 2. For convenience of explanation, in the states shown in FIG. 2 and FIGS. 3A to 3E, it is assumed that the constant-potential supply circuit 9 supplies the zero potential to the source electrode of the driver element and the potential difference between the gate and the source of the driver element 13 is equal to the gate potential.

Figure 3A:
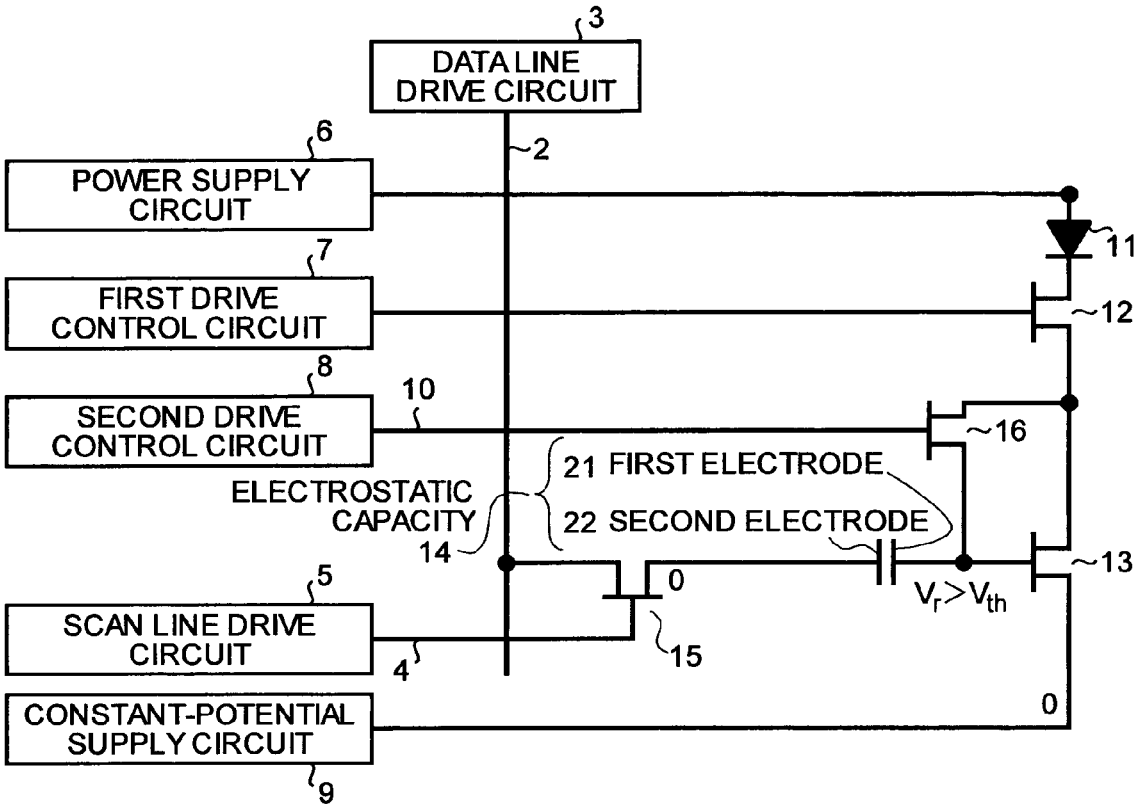
FIGS. 3A to 3E are block diagrams of a part of the image display device according to the first embodiment.

First a process of resetting the potential applied to the gate electrode of the driver element 13 in the previous light emission is performed. Specifically, as shown the period T1 of FIG. 2 and FIG. 3A, the potentials of the scan line 4, a control line 10 and the first drive control circuit 7 are changed to on potential. That is, the second switching element 12, the driver element 13, the third switching element 15, and the first switching element 16 are in an on state as shown in FIG. 3A. Accordingly, the potential of a first electrode 21 constituting the electrostatic capacity 14 becomes the value in which voltage drop in the light-emitting element 11 is subtracted from the potential supplied from the power supply circuit 6 to the anode side of the light-emitting element 11. Usually the potential supplied from the power supply circuit 6 has the sufficiently high value, so that the potential of the first electrode 21, namely the gate potential of the driver element 13 is held at the value $V_r$ higher than the threshold value $V_{th}$.

The third switching element 15 is in the on state as described above, and the potential of the data line 2 is in the zero potential as shown in FIG. 2, so that a second electrode 22 that is of the other electrode constituting the electrostatic capacity 14 becomes the zero potential. Accordingly, in the process shown in the period T1 of FIG. 2 and FIG. 3A, the potential of $V_r$ ($>V_{th}$) is supplied to the first electrode 21 and the zero potential is supplied to the second electrode 22.

As can be seen from the time chart of FIG. 2, the scan line (n−1) and the control line (n−1) located in the fore-step are also held at the on potential in the process, and the same process is also performed to the pixel circuit 1 located in the fore-step. Therefore, in the fore-step, the potential of the first electrode becomes $V_r$ and the potential of the second electrode becomes zero. The same process is performed other pixel circuits 1, and the process is simultaneously performed to all the pixel circuits. In all the pixel circuits, the potential of $V_r$ and the zero potential are supplied to the electrode plates of the electrostatic capacity 14 respectively.

Figure 3B:
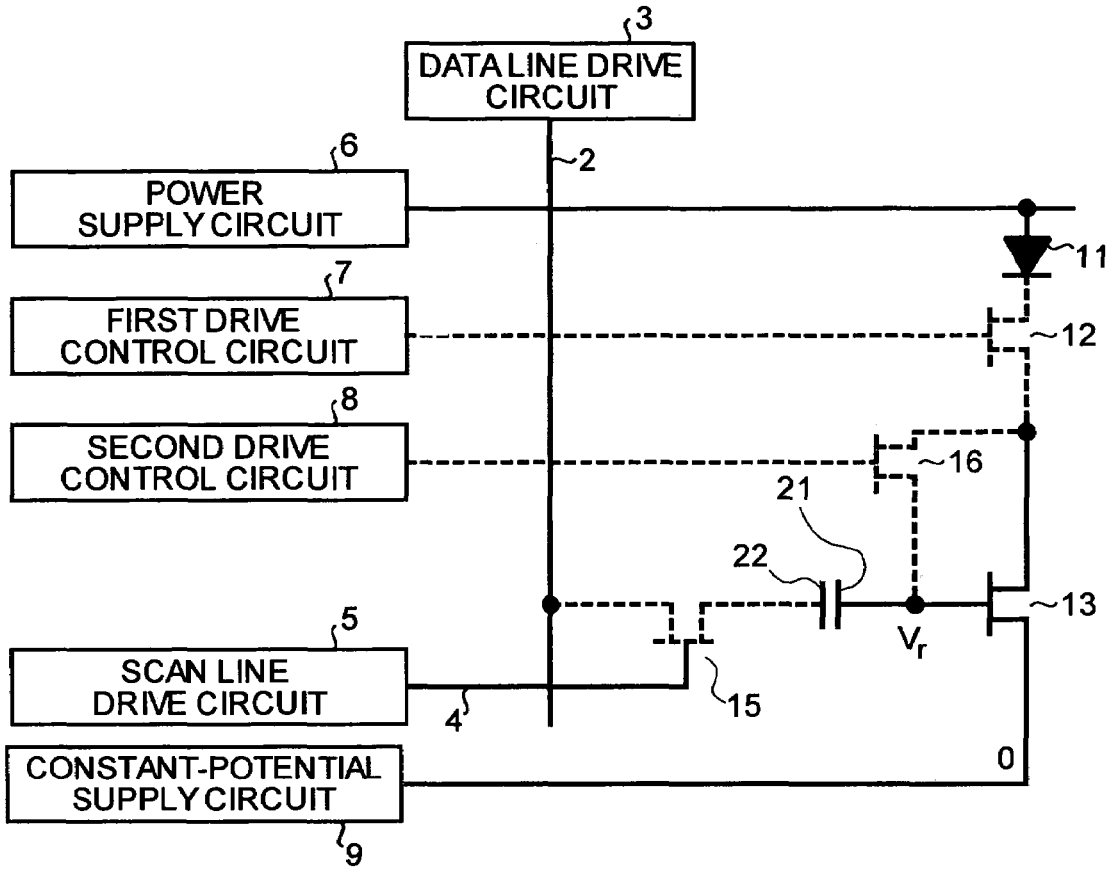

Then, the process shown in the period T2 of FIG. 2 and FIG. 3B is performed. In the process, the potentials of the scan line 4, the control line 10, and the first drive control circuit 7 are changed to off potential, and the second switching element 12, the third switching element 15, and the first switching element 16 are controlled in an off state. Accordingly, the first electrode 21 becomes the so-called floating state and charge transfer is not generated, so that the first electrode 21 holds the potential of $V_r$ supplied in the previous step.

In the process, the potential of the data line 2 becomes predetermined potential because the data line 2 supplies the potential according to the luminance to other pixel circuits 1.

Then, the threshold voltage is supplied to the first electrode 21 of the electrostatic capacity 14 and the luminance voltage is supplied to the second electrode 22. Specifically, as shown in the period T3 of FIG. 2 and FIG. 3C, the potential of the first drive control circuit 7 is held at the off potential and the second switching element 12 is held at the off state. On the other hand, the potentials of the control line 10 and the scan line 4 are changed to the on potential and the first switching element 16 and the third switching element 15 become the on state.

The change in potential of the first electrode 21 is explained. Since the first switching element 16 is changed to the on state as described above, the gate electrode and the drain electrode are electrically connected to each other in the driver element 13. As described above, until the previous process, the gate electrode of the driver element 13 is held at the potential $V_r$ that is higher than the threshold voltage $V_{th}$, and the zero potential is supplied to the source electrode by the constant-potential supply circuit 9, so that the potential difference between the gate and the source becomes $V_r$ and the driver element 13 becomes the on state. Accordingly, the gate electrode, the first switching element 16, the drain electrode, and the source electrode become in the conduction state with respect to the driver element 13, and current I is passed based on the charge held in the gate electrode. Since the current I is passed until the driver element 13 becomes the off state, finally the potential difference between the gate and the source becomes the value equal to the threshold voltage $V_{th}$ in the driver element 13 and the source electrode is held at the zero potential. This allows the potential of the gate electrode of the driver element 13, namely the potential of the first electrode 21 to become the threshold voltage $V_{th}$.

On the other hand, the potential of the second electrode 22 is changed to the luminance potential $V_{data}$ supplied through the data line 2. Since the third switching element 15 is in the on state in the process, the data line 2 and the second electrode 22 are electrically connected, and the second electrode 22 has the potential supplied from the data line. In the process, the potential of the data line 2 is controlled so as to become the luminance potential $V_{data}$ according to the luminance of the light-emitting element 11, so that the potential of the second electrode 22 is also changed to the luminance potential $V_{data}$. Thus, in the process, the threshold voltage $V_{th}$ for driving the driver element 13 is supplied to the first electrode 21, namely the gate electrode of the driver element 13, the luminance potential $V_{data}$ is supplied to the second electrode 22, and the potential difference between the electrodes of the electrostatic capacity 14 becomes ($V_{th}-V_{data}$).

Until the start of the period T4 from the start of the period T2 of FIG. 2, the same potential as the period T3 is supplied to the plurality of pixel circuits 1 located on the image display devices. Accordingly, until the period T4 is started, in all the pixel circuits 1, the potential $V_{th}$ according to the drive threshold voltage of the driver element 13 is supplied to the first electrode 21 of the electrostatic capacity 14 and the luminance potential $V_{data}$ according to the display luminance in each pixel circuit 1 is supplied to the second electrode 22.

Then, the process of changing the potential of the gate electrode of the driver element 13 so that the potential difference between the gate and the source is lower than the threshold voltage $V_{th}$ by the luminance potential $V_{data}$ is performed. Specifically, as shown in the period T4 of the FIG. 2 and FIG. 3D, while the scan line 4 and the first drive control circuit 7 supply the on potential, the control line 10 supplies the off potential. Therefore, the third switching element 15 and the first switching element 16 becomes the on state, the second switching element 12 becomes the off state, and the potential of the data line 2 is changed to the zero potential.

Figure 3C:
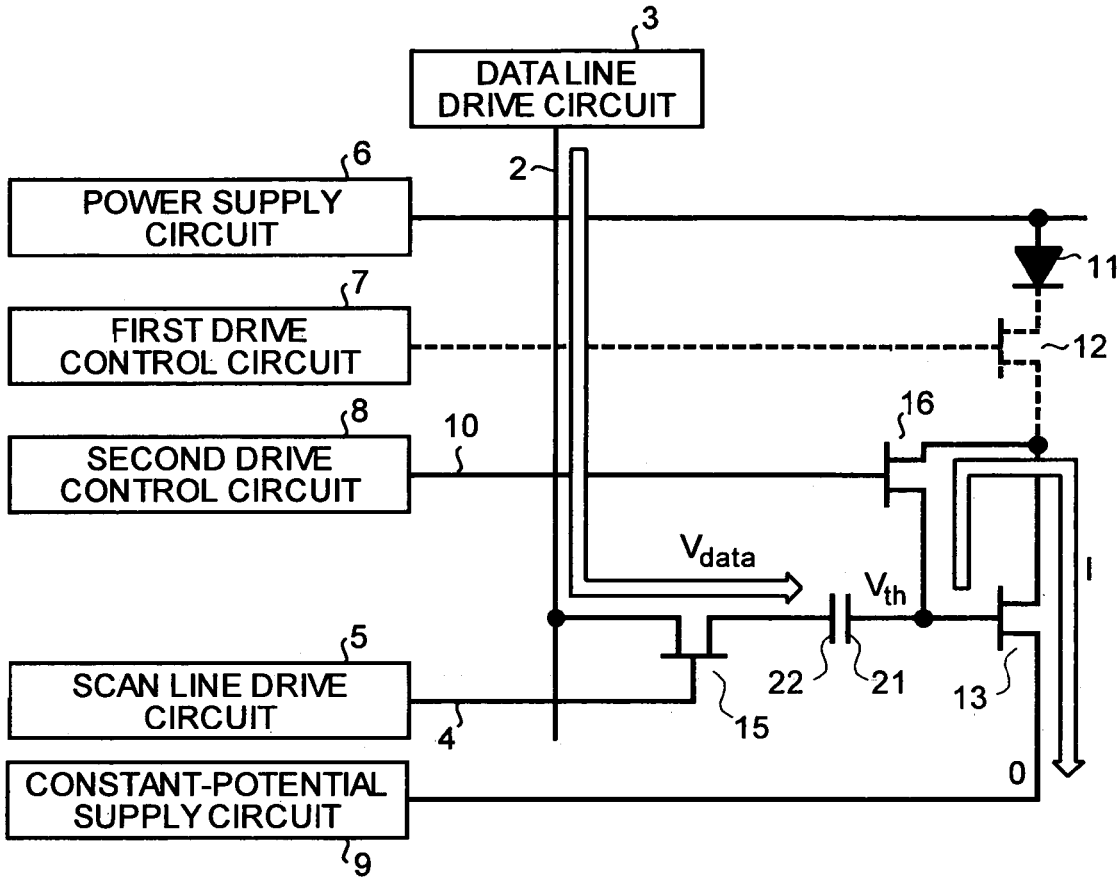
Figure 3D:
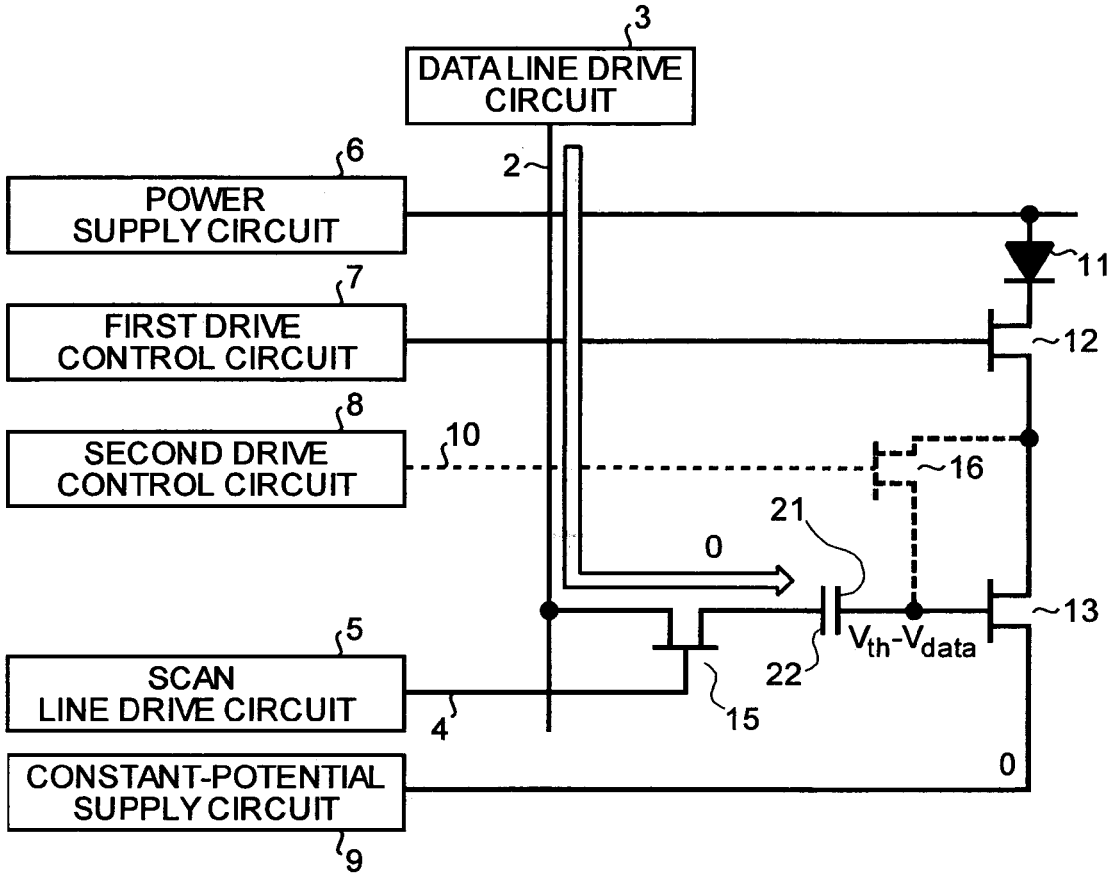

The change in potential of the driver element 13 (first electrode 21) is generated by the following mechanism. Since the third switching element 15 is in the on state, the zero potential of the data line 2 is supplied to the second electrode 22, and the potential of the second electrode 22 is changed from the luminance voltage $V_{data}$ supplied in the process of FIG. 3C to the zero potential. On the other hand, since the first switching element 16 is in the off state, the first electrode 21 is in the floating state. Therefore, the potential of the first electrode 21 sweeps while the potential difference is held between the first electrode 21 and the second electrode 22. The potential difference between the first electrode 21 and the second electrode 22 in the process of FIG. 3C is $(V_{th}-V_{data})$ as described above and the potential of the second electrode 22 becomes the zero potential, so that the potential of the first electrode 21 is changed to $(V_{th}-V_{data})$ as shown in FIG. 3D. As a result, the potential difference between the gate and the source of the driver element 13 becomes the value equal to the potential $(V_{th}-V_{data})$ of the first electrode 21, and the potential difference between the gate and the source of the driver element 13 becomes the value lower than the drive threshold voltage by the luminance potential $V_{data}$.

Finally, the light-emission process in which the light-emitting element 11 emits the light only for the time according to the display luminance is performed. Specifically, as shown in the period T5 of FIG. 2 and FIG. 3E, the first switching element 16 is held in the off state, and the second switching element 12 and the third switching element 15 are held in the on state. As shown in FIG. 2, the data line 2 supplies sweep potential $V_d(t)$ to the second electrode 22. The sweep potential $V_d(t)$ is gradually increased from the value lower than the luminance potential, for example the zero potential to potential $V_{max}$ higher than the luminance potential in a linear manner and then linearly decreased to the zero potential again. On the other hand, since the first switching element 16 is held in the off state, the first electrode 21 becomes the floating state. Therefore, the potential of the first electrode 21 sweeps according to the potential sweep of the second electrode 22 while the potential difference is held between the first electrode 21 and the second electrode 22. Specifically, since the potential difference between the first electrode 21 and the second electrode 22 in the process of FIG. 3D is $(V_{th}-V_{data})$ as described above, the potential of the first electrode 21 becomes $(V_{th}-V_{data}+V_d(t))$ in order to hold the potential difference according to the sweep potential $V_d(t)$ applied to the second electrode 22.

Figure 3E:
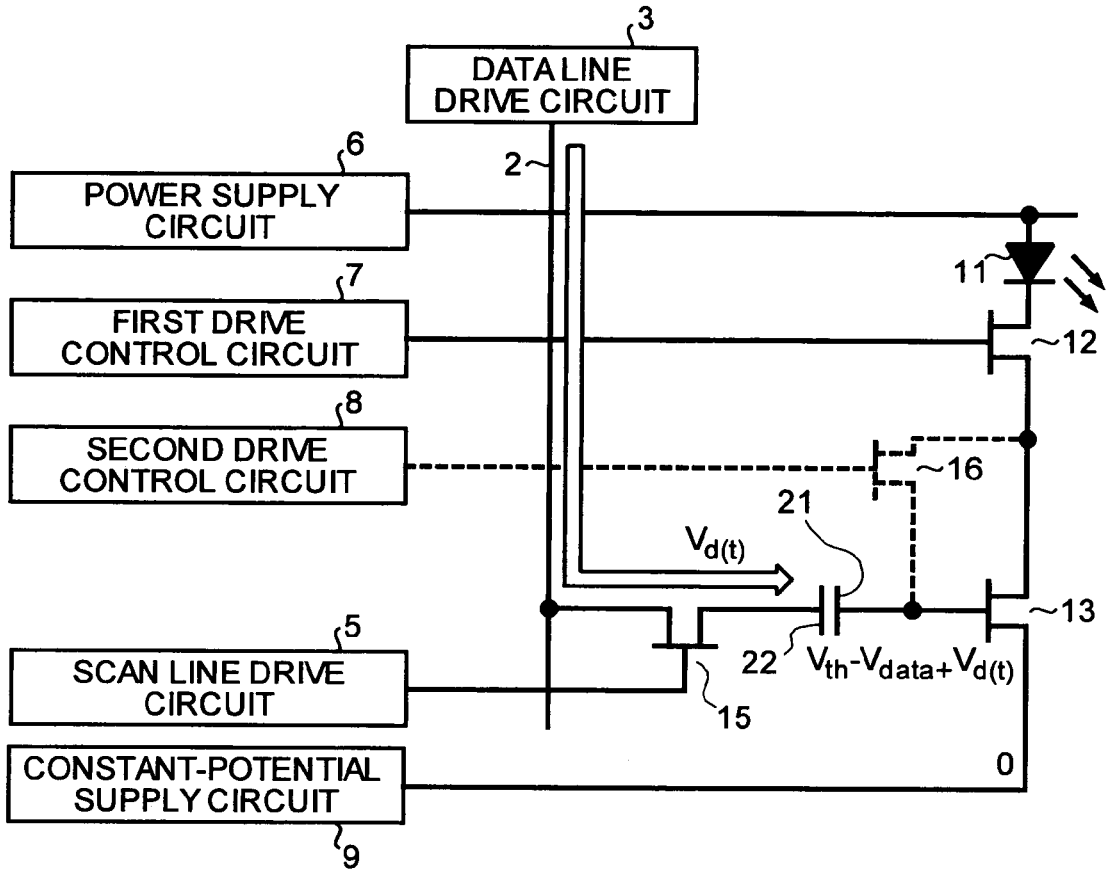
Figure 5:
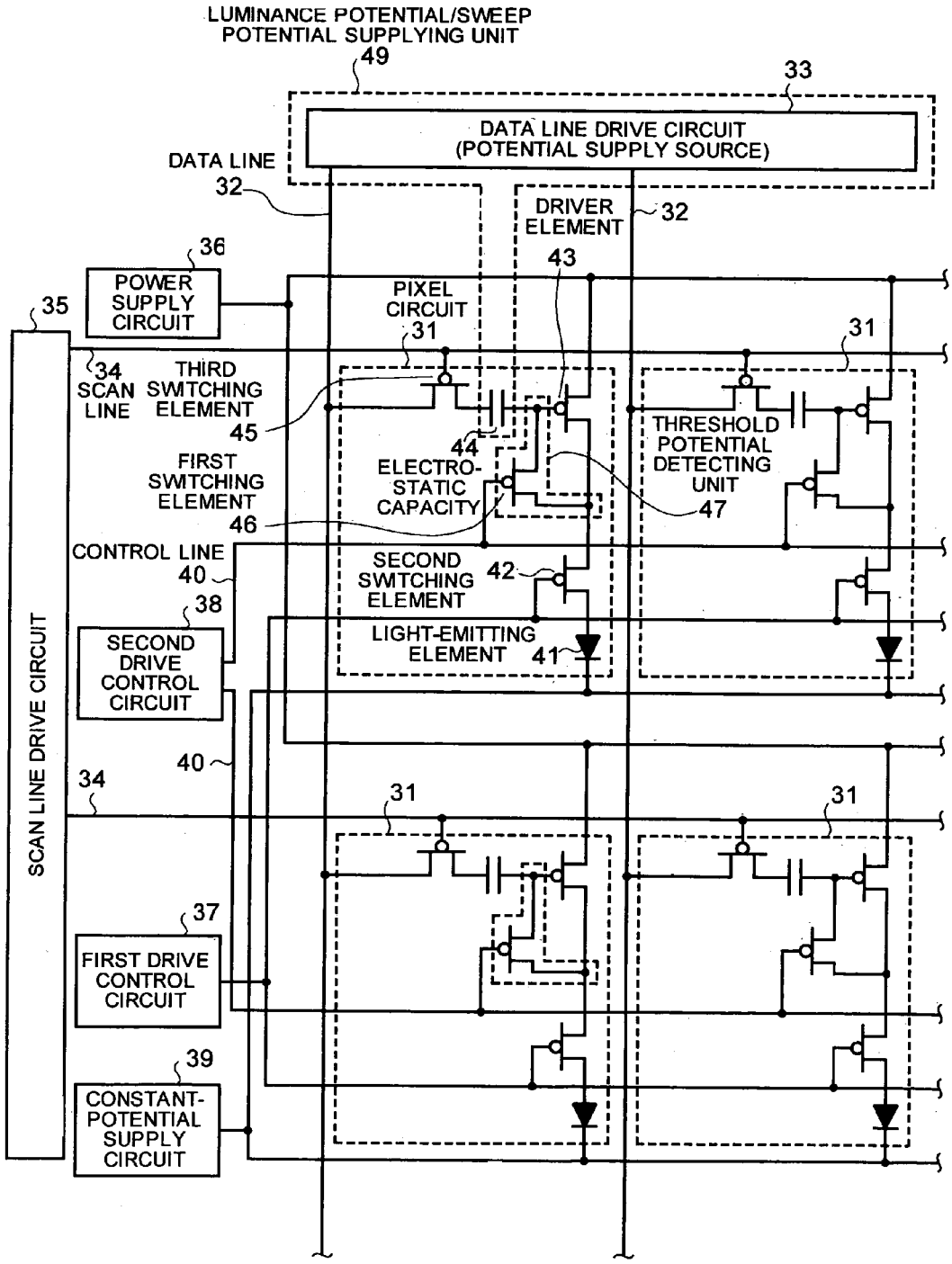
FIG. 5 is a block diagram of the image display device according to a second embodiment.

Therefore, in the process shown in the period T5 of FIG. 5 and FIG. 3E, the potential difference between the gate and the source is given by $(V_{th}-V_{data}+V_d(t))$ in the driver element 13. At this point, in order that the light-emitting element 11 emits the light, it is necessary that the driver element 13 becomes the on state to pass the current, so that it is necessary that the light emission of the light-emitting element 11 satisfies the following expression:

$$V_{th}-V_{data}+V_d(t)>V_{th} \quad (1)$$

that is, $$V_d(t)>V_{data} \quad (2)$$

Figure 4:
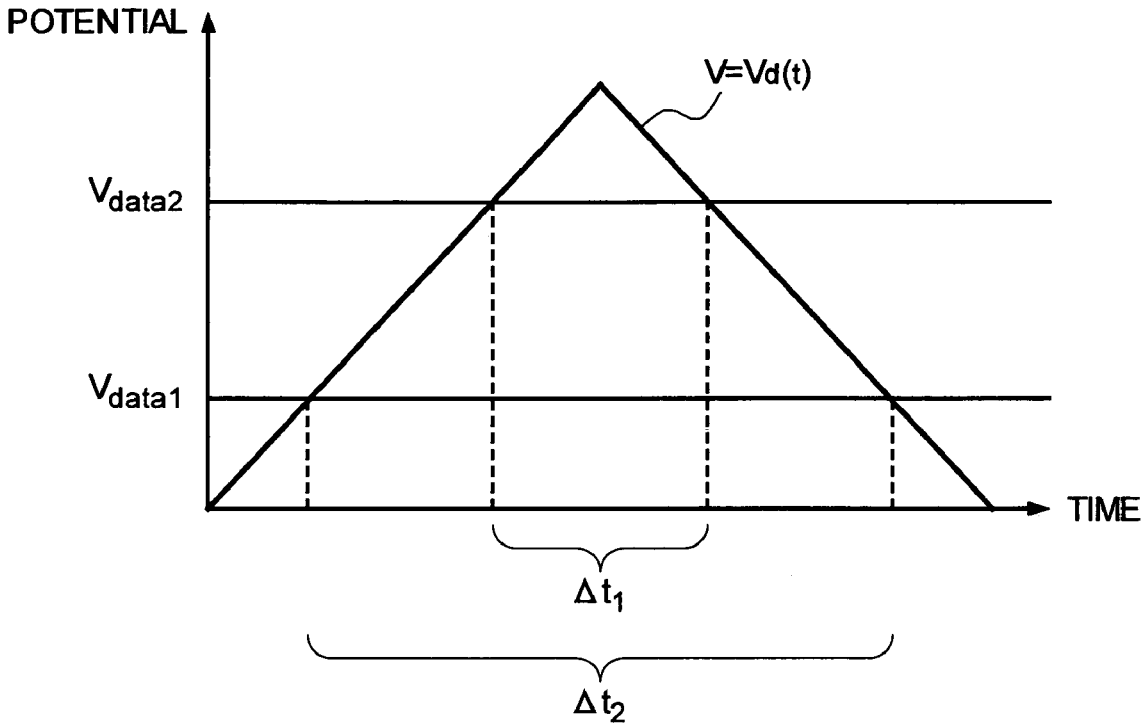
FIG. 4 is a schematic graph indicating difference in light-emission time depending on magnitude relation between the sweep potential and the luminance potential.

FIG. 4 is a graph that depicts the light-emission time of the light-emitting element 11, which is determined based on magnitude relation between the sweep potential $V_d(t)$ and the luminance potential $V_{data}$. The sweep potential $V_d(t)$ sweeps between the value lower than the luminous potential $V_{data}$ and the value higher than the luminous potential $V_{data}$. As shown in FIG. 4, the time satisfying Expression (2) is changed according to the value of $V_{data}$. Specifically, as shown in FIG. 4, the time satisfying Expression (2), namely the time during which the light-emitting element 11 emits the light becomes $\Delta t_1$ when the luminance potential is the value of $V_{data1}$, and the time during which the light-emitting element 11 emits the light becomes $\Delta t_2$ when the luminance potential is the value of $V_{data2}$. Because a user of the image display device recognizes the different luminances according to the light-emission time of the light-emitting element 11, the light-emission time of the light-emitting element 11 can be adjusted by appropriately selecting the value of the luminance potential $V_{data}$, and the display is performed with the desired luminance by adjusting the light-emission time.

Then, advantages of the image display device of the first embodiment is explained. The image display device of the embodiment has the advantage that the production cost can be reduced when compared with the conventional image display device. Specifically, as shown in FIG. 1, the image display device of the embodiment does not include the inverter, but the image display device is formed by the plurality of switching elements that include the n-type thin film transistor. It is not necessary that the image display device of the embodiment has both the p-type thin film transistor and the n-type thin film transistor, and the switching element and the like can be formed only by the n-type thin film transistor in the image display device. Therefore, the thin film transistors forming, the pixel circuits can be produced by the same process, and the production cost can be reduced when compared with the production of the thin film transistors having the different conduction types through the different processes.

The image display device of the first embodiment has the advantage that the power consumption is decreased when compared with the conventional image display device. Since the image display device of the first embodiment does not include the inverter, it is not necessary to perform the reset process by establishing the short circuit between the output terminal and the output terminal of the inverter. Therefore, in the image display device of the first embodiment, it is not necessary to consider the power consumption generated by the reset process, so that the image display device of the embodiment can reduce the power consumption by the reset process when compared with the conventional image display device. In the image display device of the embodiment, the reset process is also performed in the period T1 of FIG. 2 and FIG. 3A. However, the reset process in the embodiment is completely different from the reset process of the inverter, and the reset process in the embodiment never largely increases the power consumption.

The image display device of the first embodiment has the configuration in which the drive threshold voltage of the driver element 13 controlling the light-emission time of the light-emitting element 11 is really detected. That is, the image display device of the first embodiment has the configuration the real drive threshold voltage is detected by driving each driver element 13. Therefore, even when variations are generated in electrical characteristics due to the difference in particle diameter and the like such that a channel formation layer is formed by polysilicon, the potential can be supplied corresponding to the real drive threshold voltage, so that the image display device of the embodiment can perform the luminance display accurately corresponding to the luminance to be displayed.

The image display device of the first embodiment controls the light-emission time of the light-emitting element 11 by giving the sweep potential $V_d(t)$. This means that the light-emission time can be changed by changing the waveform of the sweep potential $V_d(t)$ to change the luminance recognized by the user even if the same luminance potential $V_{data}$ is given. Therefore, gamma correction and the like can be performed by adjusting the waveform of the sweep potential $V_d(t)$.

An image display device according to a second embodiment is explained below. The image display device of the second embodiment has the configuration in which only the p-conduction type thin film transistors are used in the pixel circuits.

FIG. 5 is a block diagram of the image display device according to the second embodiment. As shown in FIG. 5, the image display apparatus includes a plurality of pixel circuits 31 arranged in the matrix shape, a data line drive circuit 33 that supplies the luminance potential to the pixel circuits 31 through a data line 32, and a scan line drive circuit 35 that supplies the scanning signal through a scan line 34, a power supply circuit 36 that supplies the drive power to the light-emitting element, a first drive control circuit 37 that supplies the potential for controlling the conduction state between the light-emitting element and the power supply circuit 36, a second drive control circuit 38 that supplies the potential in detecting the threshold voltage and the like, and a constant-potential supply circuit 39 that supplies the reference potential.

The pixel circuit 31 includes a light-emitting element 41 whose cathode side is electrically connected to the constant-potential supply circuit 39, a driver element 43, and a second switching element 42 that controls the conduction state between the light-emitting element 41 and the driver element 43. The driver element 43 controls the light-emission time of the light-emitting element 41 by controlling the current passing through the light-emitting element 41 based on the potential difference supplied between a first terminal (gate electrode) and a second terminal (source electrode) of the driver element 43. The pixel circuit 31 also includes a first switching element 46 that controls the conduction state between the first terminal and the second terminal as a threshold voltage detecting unit 47 that detects the drive threshold voltage between the first terminal and the second terminal of the driver element 43. The pixel circuit 31 also includes an electrostatic capacity 44 whose one electrode plate (first electrode) is connected to the first terminal of the driver element 43 and a third switching element 45 that controls the conduction state between the other electrode (second electrode) of the electrostatic capacity 44 and the data line 32. A luminance potential/sweep potential supplying unit 49 is formed by the electrostatic capacity 44 and the data line drive circuit 33.

The second switching element 42, the driver element 43, the third switching element 45, and the first switching element 46 are formed while including the p-type thin film transistor respectively. The gate electrode of the second switching element 42 is connected to the first drive control circuit 37, the gate electrode of the third switching element 45 is connected to the first drive control circuit 37, the gate electrode of the third switching element 45 is connected to the scan line 34, and the gate electrode of the first switching element 46 is connected to the second drive control circuit 38 through a control line 40.

Figure 6:
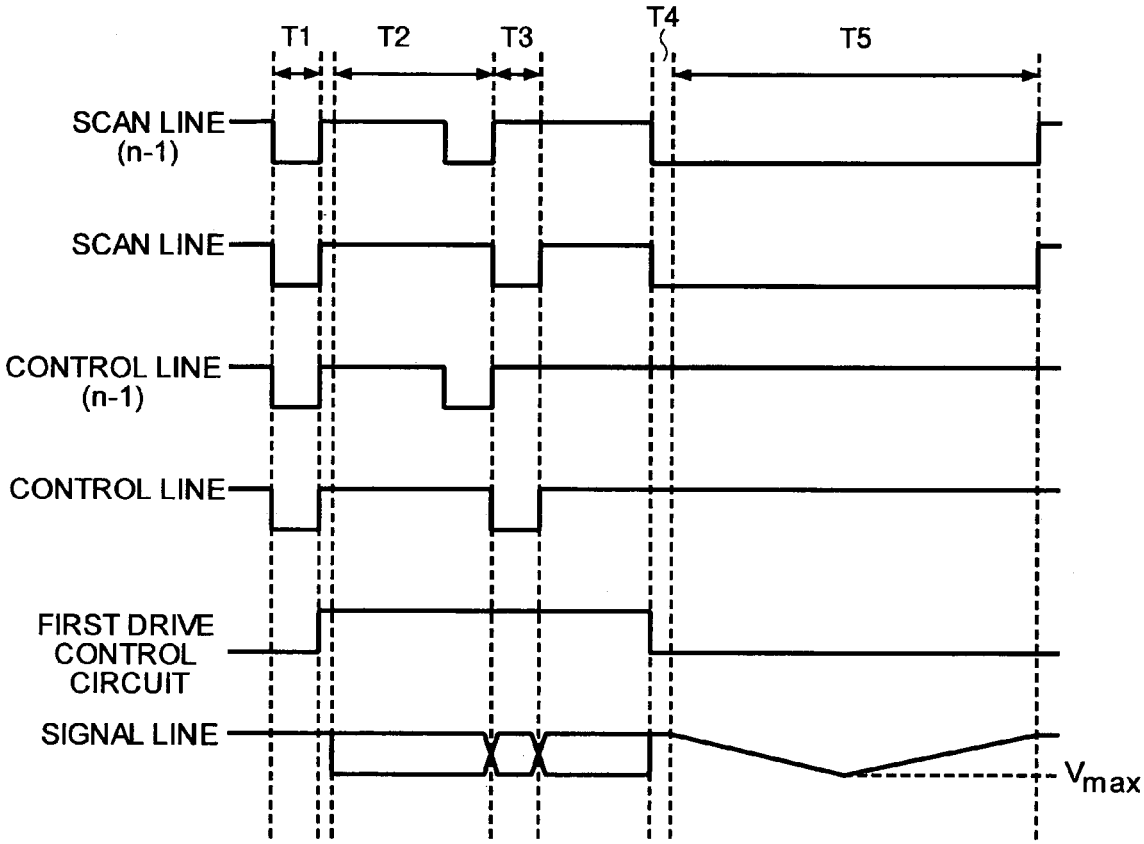
FIG. 6 is a time chart of potential sweep at some nodes of the image display device according to the second embodiment.

In the image display device of the second embodiment, the thin film transistors included in the pixel circuit 31 are formed using the p-type thin film transistor. Accordingly, the potentials supplied to the pixel circuit 31 by data line 32, the scan line 34, the control line 40, and the first drive control circuit 37 become the time chart in which the time chart shown in FIG. 2 is inverse. The image display device of the second embodiment is operated according to the time chart shown FIG. 6. Similarly to the first embodiment, the potential $V_r$ ($>V_{th}$) is supplied to the gate electrode of the driver element 43 during the period T1, and the threshold voltage $V_{th}$ is applied to the first electrode of the electrostatic capacity while the luminance potential $V_{data}$ is applied to the second electrode during the period T3. Then, the potential of the first electrode is changed during the period T4, the sweep potential $V_d(t)$ is given during the period T5, and the light-emitting element 41 emits the light for the time according to the luminance.

Thus, the image display device of the second embodiment is formed only by the p-type thin film transistors included in the pixel circuits 31, and the image display device of the second embodiment realizes the configuration having the same function as the first embodiment by inverting the potential supplied to the components of the pixel circuits 31. Therefore, the image display device of the second embodiment has the advantages that all the thin film transistors in the pixel circuit 31 can be formed through the same process because the thin film transistors have the p-type electrical conductivity and the power consumption can be reduced because the image display device does not include the inverter. Further, the image display device of the second embodiment has the configuration in which the threshold voltage of the driver element 43 is really detected during the period T3 of FIG. 6, so that the image display device can perform the luminance display accurately corresponding to the luminance to be displayed even if the variations are generated in the electrical characteristics of the driver element 43.

An image display device according to a third embodiment is explained below. The image display device of the third embodiment has the configuration in which the scan line, the scan line drive circuit, and the third switching element in the first and second embodiments are omitted.

Figure 7:
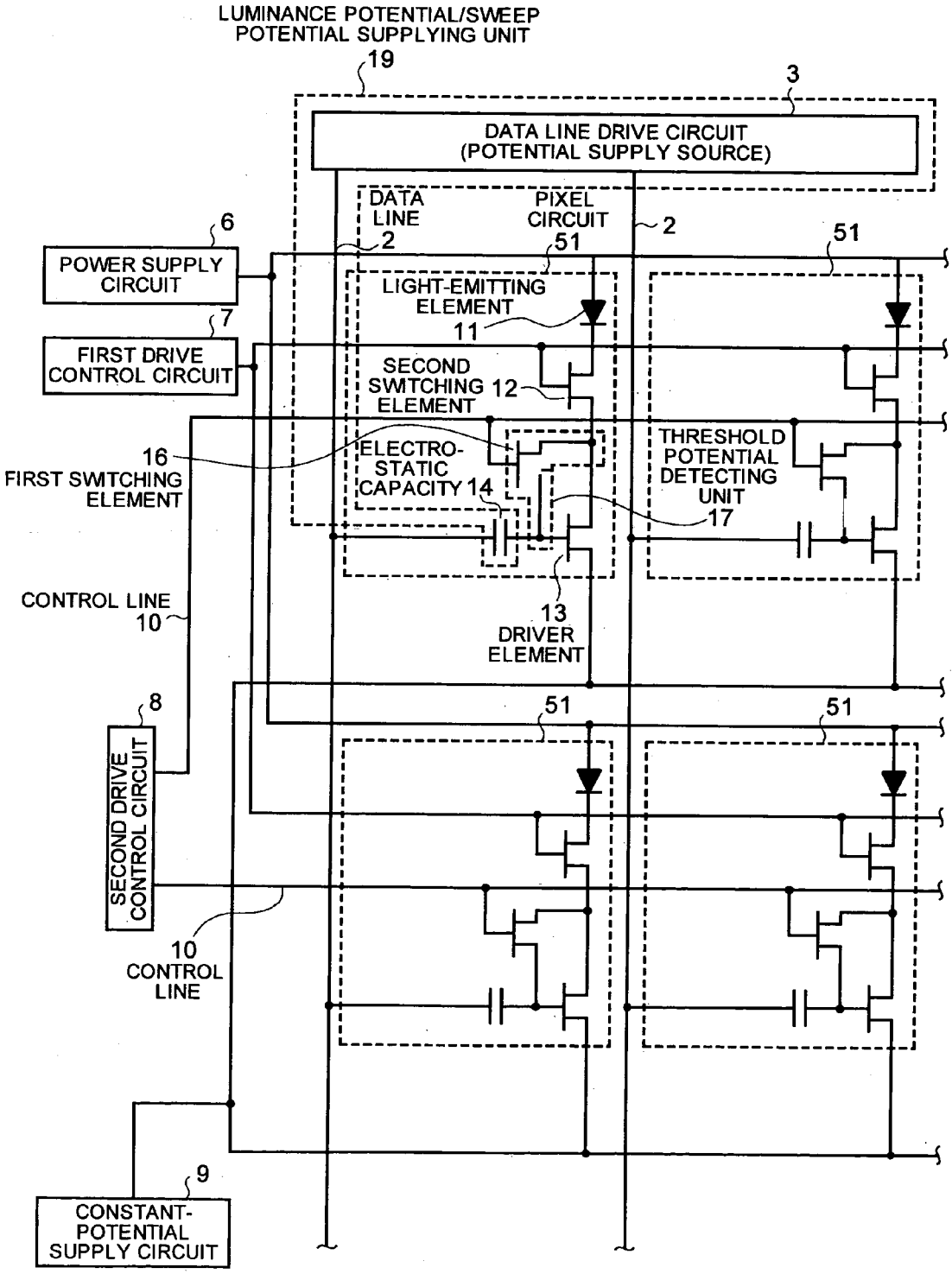
FIG. 7 is a block diagram of the image display device according to a third embodiment.

FIG. 7 is a block diagram of the image display device according to the third embodiment. As shown in FIG. 7, in the image display device, the data line 2 and the electrostatic capacity 14 are electrically directly connected to each other in a plurality of pixel circuits 51 arranged in the matrix shape, and a circuit element corresponding to the third switching element is neglected. Accordingly, the image display device of the third embodiment has the configuration in which the scan line and the scan line drive circuit are omitted corresponding to the omission of the third switching element.

Figure 8:
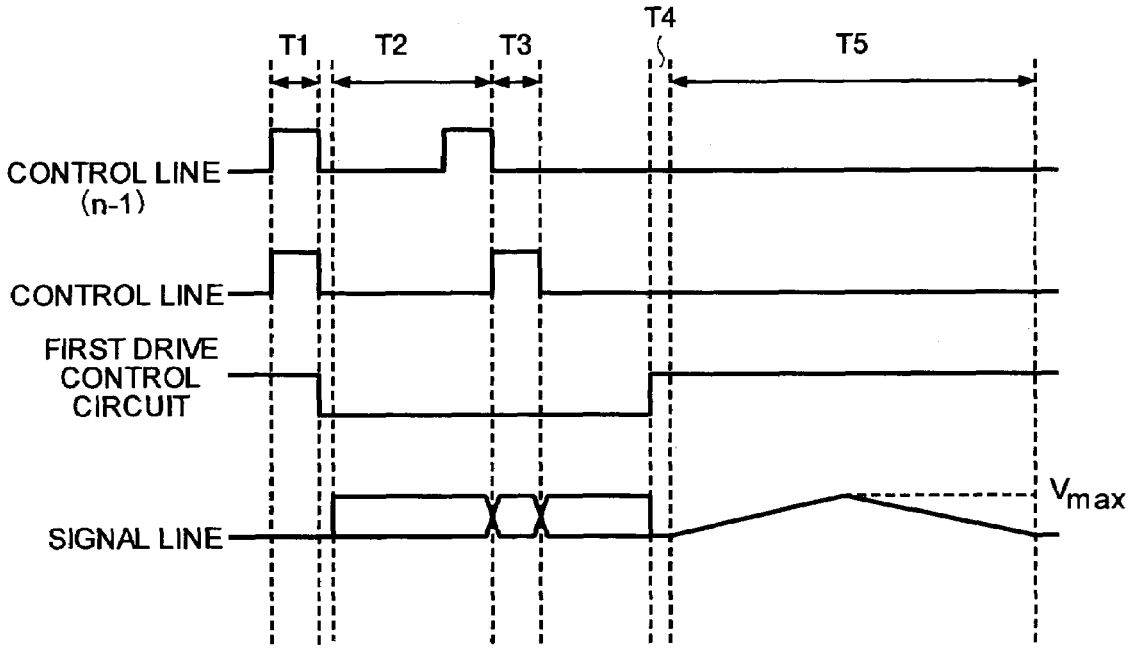
FIG. 8 is a time chart of potential at some nodes of the image display device according to the third embodiment.

FIG. 8 is a time chart of the potential at some nodes of the image display device according to the third embodiment. As can be seen from comparison between FIG. 8 and FIG. 2, even if the configuration in which the third switching element is omitted to directly connect the data line 2 and the electrostatic capacity 14 is adopted, the image display can be performed without particularly changing the potential sweeps of other components. Similarly to the first and second embodiments, the configuration in which, after the drive threshold voltage of the driver element 13 is detected, the potential difference between the gate and the source is decreased by the luminance potential in the driver element 13 to give the sweep potential changed from the value lower than the luminance potential to the value higher than the luminance potential is adopted for the image display device of the third embodiment. Accordingly, similarly to the first and second embodiments, the image display apparatus with low production cost and low power consumption can be also realized in the third embodiment. Since the third embodiments adopts the configuration in which the scan line drive circuit, the scan line, and the third switching element are omitted, the further reductions of the production cost and the power consumption can be realized. Although the case in which the pixel circuit 51 is formed only by the n-type thin film transistors is shown in FIGS. 7 and 8, similarly to the second embodiment, it is also possible that the pixel circuit is formed only by the p-type thin film transistor.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image display device comprising:

a light emitting unit that emits light by current injection;

a driving unit that includes a first terminal and a second terminal, and controls current flowing through the light emitting unit based on a potential difference applied between the first terminal and the second terminal, the potential difference being higher than a predetermined drive threshold;

a threshold potential detecting unit that detects the potential difference;

a luminance potential supplying unit that changes an absolute value of the potential difference to a value lower than the drive threshold by a luminance potential corresponding to a luminance of the light emitting unit; and a sweep potential supplying unit that controls the driving unit by supplying a sweep potential to the first terminal after the absolute value of the potential difference is changed by the luminance potential supplying unit, the sweep potential being swept in a range between a value lower than the luminance potential and a value higher than the luminance potential, wherein the driving unit includes a thin film transistor that has a gate connected to the first terminal, a source connected to the second terminal, and a drain, the threshold potential detecting unit includes a first switching unit that detects the potential difference by shorting between the gate and the drain, the luminance potential supplying unit includes an electrostatic capacity that has a first electrode connected to the gate and a second electrode opposite to the first electrode, and a potential supply source that supplies a potential to the second electrode, and a potential of the second electrode is changed from a reference potential by the luminance potential when the first switching unit shorts between the gate and the drain, and the potential of the second electrode is changed to the reference potential again after the gate and the drain are shorted, thereby a potential difference between the gate and the source drops by the luminance potential.

2. The image display device according to claim 1, wherein the sweep potential supplying unit is integrated with the luminance potential supplying unit, and the potential supply source supplies the sweep potential to the gate through the electrostatic capacity while a circuit between the gate and the drain is opened by the first switching unit.

3. The image display device according to claim 1, further comprising:

a current source that supplies the current to the light emitting unit;

a second switching element that opens a circuit between the current source and the light emitting unit when the threshold potential detecting unit and the luminance potential supplying unit are operated, and electrically connects between the current source and the light emitting unit when the sweep potential supplying unit is operated; and a third switching unit that controls a conduction between the potential supply source and the second electrode, wherein the first switching unit, the second switching unit, and the third switching unit include a thin film transistor whose conductive type is the same as conductive type of the thin film transistor of the driving unit.

4. The image display device according to claim 1, wherein the light emitting unit is an organic light emitting diode.

* * * * *